United States Patent [19]

Hefling

[11] Patent Number: 4,881,520

[45] Date of Patent: Nov. 21, 1989

[54] PROPANE-FUELED COOKING APPARATUS

[75] Inventor: Dennis V. Hefling, Wichita, Kans.

[73] Assignee: The Coleman Company, Inc., Wichita, Kans.

[21] Appl. No.: 120,038

[22] Filed: Nov. 13, 1987

Related U.S. Application Data

[63] Continuation-in-part of Ser. No. 930,520, Nov. 14, 1986, Pat. No. 4,759,339.

[51] Int. Cl.[4] ..... F24C 3/04; F24C 3/08

[52] U.S. Cl. ..... 126/44; 126/38; 431/344

[58] Field of Search ..... 126/38, 44, 41 R, 39 R, 126/39 E, 304, 40; 431/344, 355, 343

[56] References Cited

U.S. PATENT DOCUMENTS

| | | | |
|---|---|---|---|
| 2,825,325 | 3/1958 | Ross | 431/344 X |
| 3,574,505 | 4/1971 | Kimball | 126/44 X |
| 3,933,146 | 1/1976 | Hastings | 126/38 |
| 4,284,058 | 8/1981 | Lutz | 126/9 R |
| 4,334,462 | 6/1982 | Hefling | 126/9 R X |
| 4,445,495 | 5/1984 | Frost | 431/343 X |
| 4,542,733 | 9/1985 | Chane | 126/41 R |
| 4,705,020 | 11/1987 | Hahn | 126/38 X |

FOREIGN PATENT DOCUMENTS

| | | | |
|---|---|---|---|
| 1350068 | 12/1962 | France | 126/38 |
| 775394 | 5/1957 | United Kingdom | 126/40 |
| 1212091 | 11/1970 | United Kingdom | 431/344 |

*Primary Examiner*—Carl D. Price

[57] ABSTRACT

A cooking apparatus is fueled by a disposable propane tank which is supported by a regulator assembly below the casing of the cooking apparatus. The regulator assembly is attached to the bottom of the casing by a mounting bracket, and a burner assembly is mounted on the bottom of the casing inside of the casing. Fuel is conducted from the regulator assembly to the burner assembly by a venturi tube which extends through the bottom of the casing into the burner assembly.

5 Claims, 3 Drawing Sheets

FIG. 1
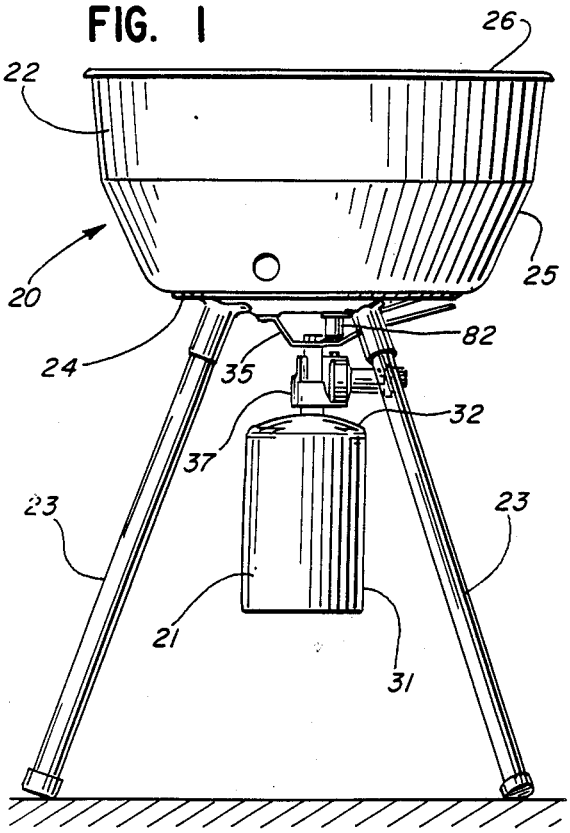
FIG. 2
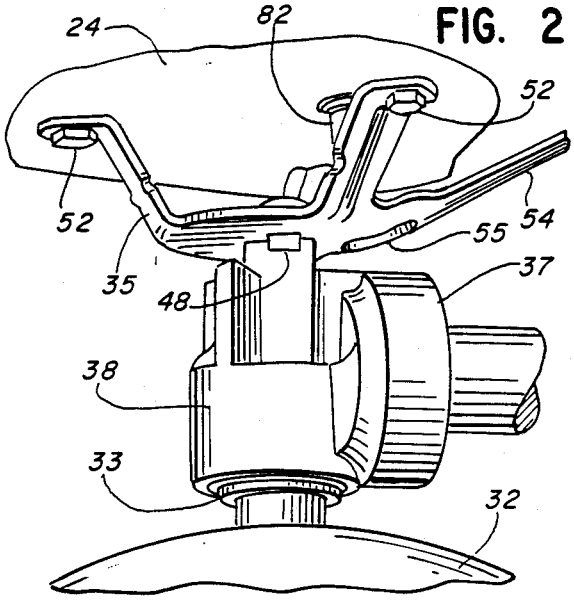
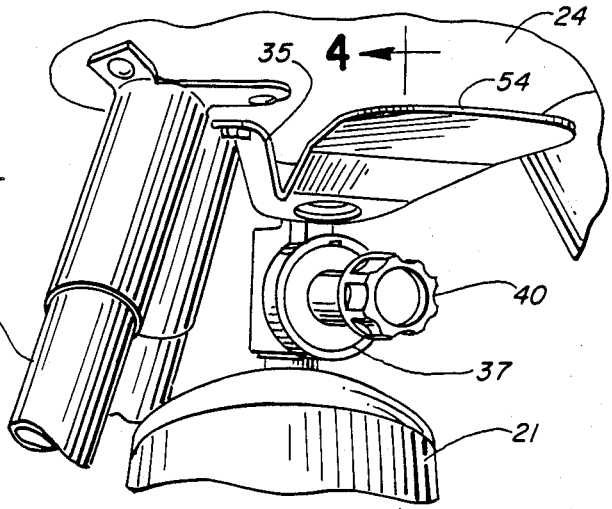
FIG. 3
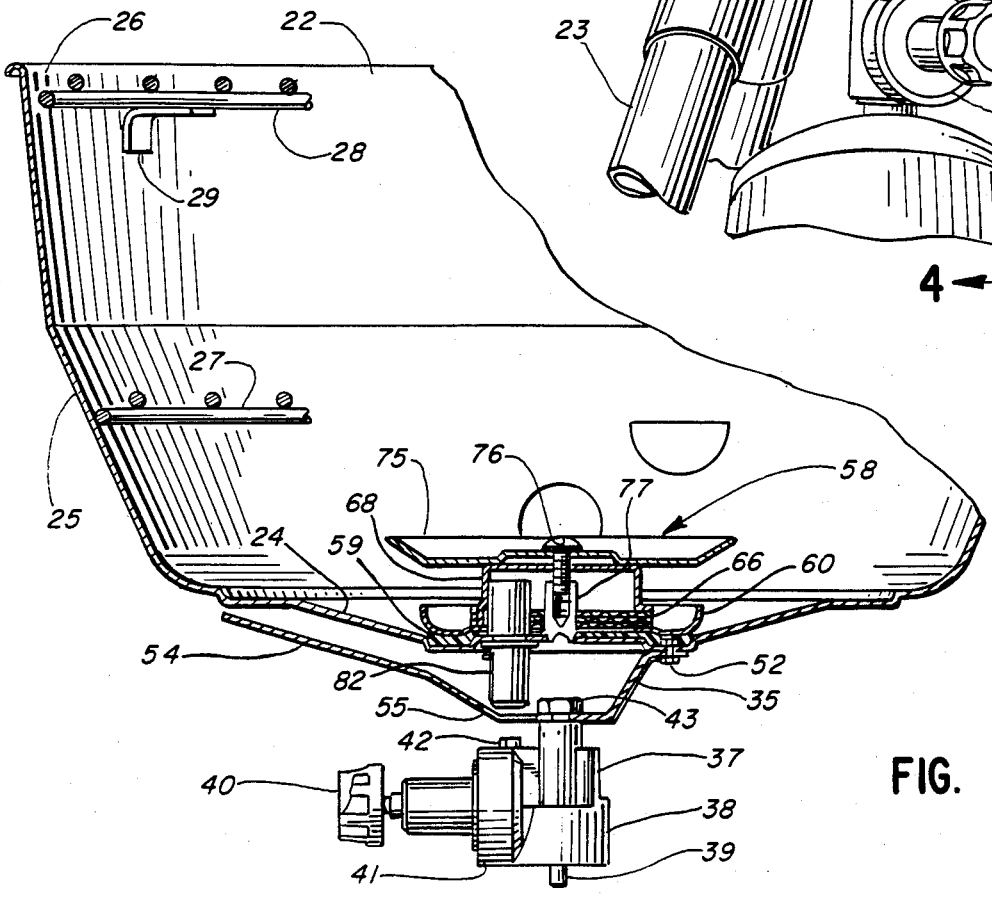
FIG. 4

FIG. 11
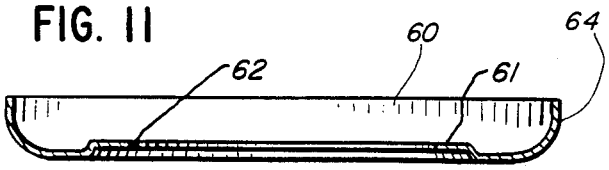
FIG. 13
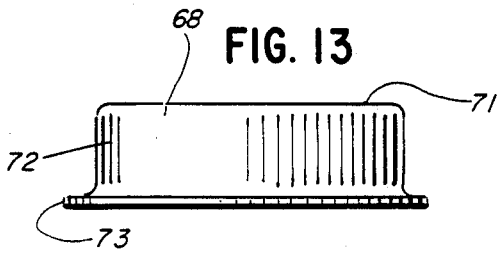
FIG. 12
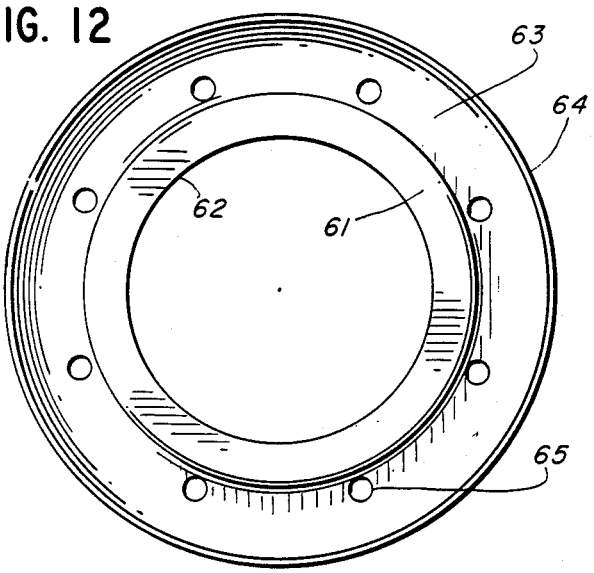
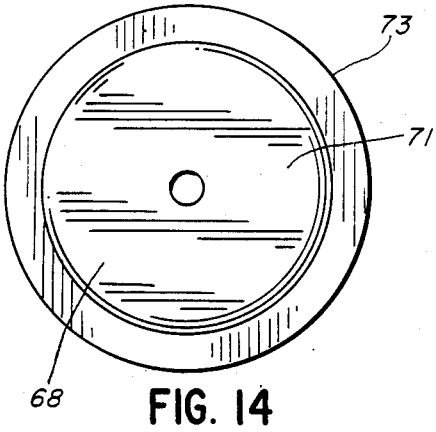
FIG. 14
FIG. 15
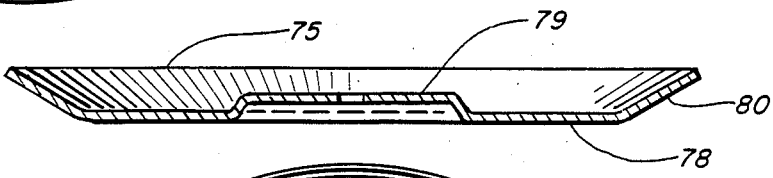
FIG. 16
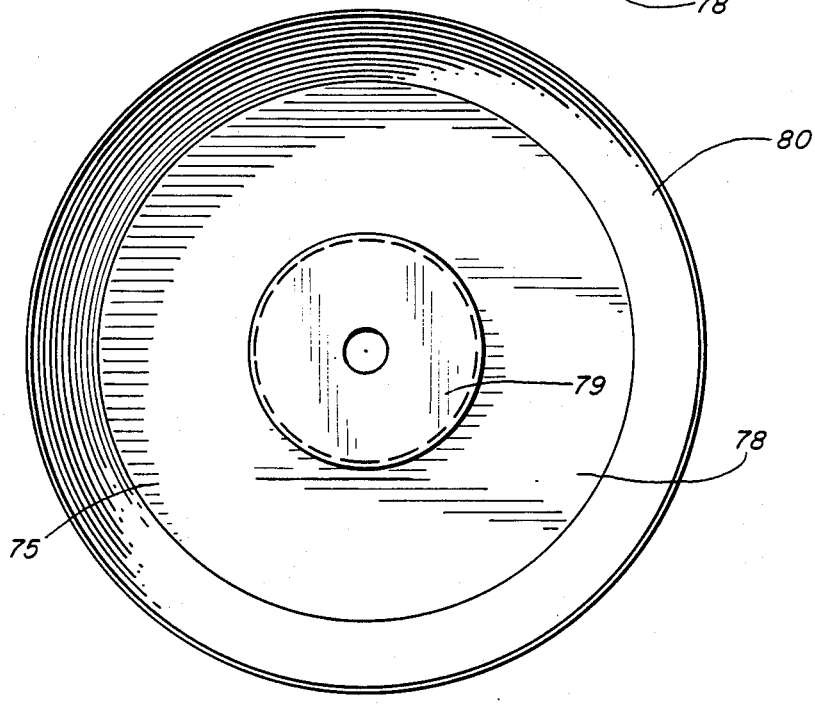

PROPANE-FUELED COOKING APPARATUS

RELATED APPLICATION

This application is a continuation-in-part of my co-pending application entitled "Compact Single Burner Propane Campstove," Ser. No. 930,520, filed Nov. 14, 1986, now U.S. Pat. No. 4,759,339.

BACKGROUND AND SUMMARY

This invention relates to a propane-fueled cooking apparatus, and, more particularly, to a cooking apparatus such as a barbecue or a smoker which supports a propane fuel tank below the casing of the cooking apparatus.

My co-pending United States application entitled "Compact Single Burner Propane Campstove," Ser. No. 930,520, now U.S. Pat. No. 4,759,339 describes a cooking apparatus such as a campstove which is supported on top of a propane fuel tank. My prior U.S. Pat. No. 4,334,462 describes a cooking apparatus such as a barbecue or a smoker which utilizes propane fuel. The propane tank is connected to a regulator on the side of the barbecue.

The invention provides a cooking apparatus which supports a propane fuel tank below the casing of the cooking apparatus so that no other support is needed for the tank. A regulator is mounted on the bottom wall of the casing, and a burner assembly is mounted on the bottom wall inside of the casing. A venturi tube extends from the regulator through the bottom of the casing and into the burner assembly. The regulator includes a threaded connector, and the propane tank is supported by the cooking apparatus by screwing the threaded outlet of the tank into the connector.

DESCRIPTION OF THE DRAWING

The invention will be explained in conjunction with an illustrative embodiment shown in the accompanying drawing, in which FIG. 1 is a side elevational view of a cooking apparatus constructed in accordance with the invention;

FIG. 2 is an enlarged fragmentary perspective view of the regulator assembly;

FIG. 3 is an enlarged fragmentary perspective view of the regulator assembly from a different angle;

FIG. 4 is an enlarged fragmentary sectional view taken along the line 4—4 of FIG. 3;

FIG. 11 is a sectional view of the burner bowl;

FIG. 12 is a top plan view of the burner bowl;

FIG. 13 is an elevational view of the burner cap;

FIG. 14 is a top plan view of the burner cap;

FIG. 15 is a sectional view of the deflector cap; and

FIG. 16 is a top plan view of the deflector cap.

DESCRIPTION OF SPECIFIC EMBODIMENT

Figure 5:
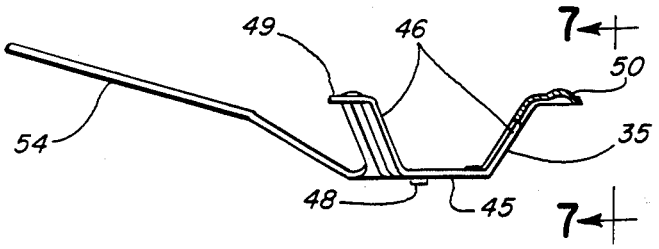
FIG. 5 is a side elevational view, partially broken away, of the mounting bracket for the regulator.

Referring to FIGS. 1–4, the numeral 20 designates generally a cooking apparatus which is fueled by a conventional disposable propane bottle or tank 21. The particular cooking apparatus illustrated is a barbecue grill which includes a grill casing 22 which is supported by three legs 23.

The casing is generally bowl-shaped and includes a bottom wall 24 and a generally frusto-conical side wall 25 which provides a top opening 26. A grate 27 (FIG. 4) for rock briquettes is supported by the side wall, and a meat grate 28 is supported by brackets 29 which are attached to the side wall. The open top of the casing may be closed by a lid (not shown).

The grill casing is similar to the grill casing described in U.S. Pat. No. 4,334,462, and additional details are provided in the patent. As described in the patent, the casing can also be used as a smoker by mounting a cylindrical extension on the top of the casing.

The propane tank 21 is conventional and includes a cylindrical side wall 31, a dome-shaped top 32, and an outlet bushing 33 (FIG. 2). The outlet bushing is provided with an external screw thread, and a valve is mounted inside of the bushing.

A conventional regulator 37 is mounted below the grill casing by a mounting bracket 35. The details of the regulator are well known, and such regulators are used, for example, on propane lanterns sold by The Coleman Company, Inc. of Wichita, Kansas. The regulator assembly includes a housing which has an internally threaded connector 38 into which the outlet bushing 33 of the propane tank is screwed. A probe 39 (FIG. 4) extends downwardly from the center of the connector for opening the valve of the propane tank.

A control knob 40 extends outwardly from a circular bushing 41 on the regulator housing and controls the flow of fuel through the regulator assembly. The fuel exits the regulator assembly through a gas jet or orifice in an externally threaded rod 42 (FIG. 4) which is screwed into the top of the bushing 41.

Figure 6:
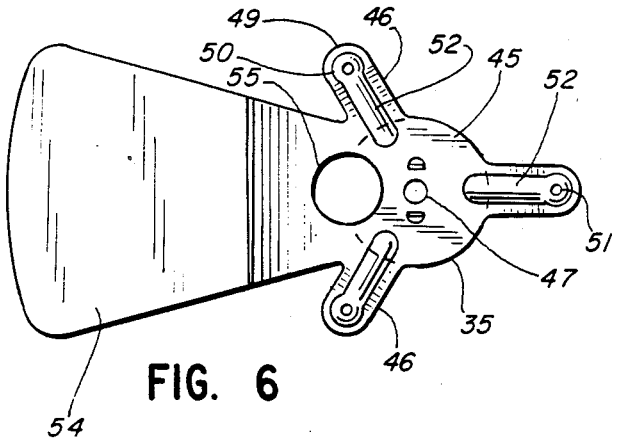
FIG. 6 is a top plan view of the mounting bracket.
Figure 7:
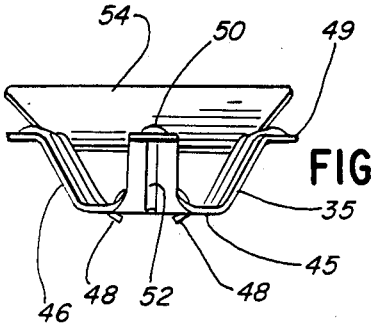
FIG. 7 is a side elevational view taken along the line 7—7 of FIG. 5.

The support bracket 35 is attached to the top of the regulator housing 37 directly above the connector 38 by a bolt 43. Referring to FIGS. 5–7, the support bracket 35 includes a central portion 45 and three arms 46 which extend outwardly and upwardly from the central portion 45. The central portion 45 is provided with an opening 47 for the bolt 43, and a pair of tabs 48 are punched downwardly out of the central portion on opposite sides of the opening. The tabs 48 contact opposite sides of the regulator housing 37 and prevent rotation of the regulator relative to the support bracket.

Each of the arms 46 of the support bracket terminates in an end portion 49 which extends parallel to the central portion 45. An upwardly convex dimple or embossment 50 is formed in each end portion, and a bolt hole 51 extends through the center of the dimple. A reinforcing rib 52 is formed in the center of each arm. Each of the arms 46 is attached to the bottom wall 24 of the grill casing 25 by a bolt 52 (FIG. 4) which extends through the opening 51 in the end of the arm. The dimples 50 minimize heat conduction between the grill casing and the support bracket.

A guard tab 54 extends outwardly and upwardly from the central portion 45 of the support bracket and extends between the bottom of the grill casing and the control knob 40 of the regulator (see FIG. 4). The guard 54 provides further insulation for the regulator assembly and protects the control knob 40 from meat drippings which may fall through ventilation openings in the grill casing. A fuel opening 55 is provided in the guard 54 and the central portion 45 of the mounting bracket above the gas jet 42.

Figure 9:
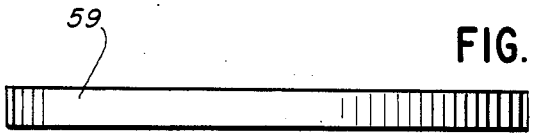
FIG. 9 is an elevational view of the burner pad.
Figure 10:
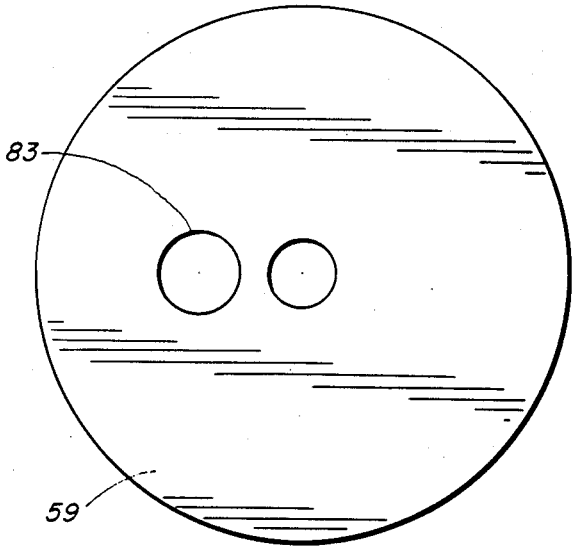
FIG. 10 is a top plan view of the burner pad.

A burner assembly 58 (FIG. 4) is mounted on the top of the bottom wall 24 of the grill casing inside the casing. The burner assembly 58 includes a circular burner pad 59 (see also FIGS. 9 and 10) which is formed of insulating material and which is supported by the bottom wall 24 of the grill casing. A burner bowl 60 is supported by the burner pad. Referring to FIGS. 11 and 12, the burner bowl 60 includes a flat annular portion 61 which is provided with a central opening 62, a trough portion 63, and an upwardly curved side wall 64. Eight holes 65 are punched in the trough portion 63.

A plurality of corrugated burner rings 66 are supported by the annular portion 61 of the burner bowl. The burner rings 66 are conventional and are sold by The Coleman Company, Inc. under the trademark Band-A-Blue. Details of the burner rings re described in Patent No. 3,933,146.

A burner cap 68 is mounted on the burner rings. The burner cap includes a flat top wall 71 (FIGS. 13 and 14), a cylindrical side wall 72, and an outwardly flared bottom flange 73.

A dish-shaped deflector cap 75 is mounted on top of the burner cap 68. The deflector cap 75 and the burner cap 68 are secured by a bolt 76 which is screwed into a retainer stub 77 which is secured to the bottom wall 24 of the grill casing. Referring to FIGS. 15 and 16, the deflector cap 75 includes a bottom wall 78 which includes a raised central portion 79 and a flared side wall 80. The deflector cap collects meat drippings and prevents the drippings from falling into the flame which surrounds the burner rings 66.

Figure 8:
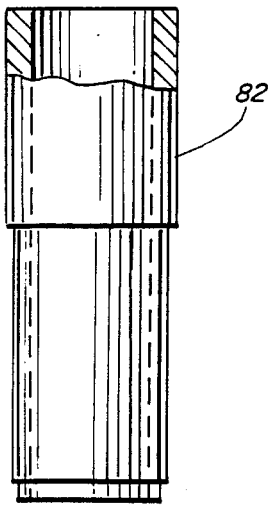
FIG. 8 is an elevational view, partially broken away, of the venturi tube.

Fuel is conducted from the gas jet 42 to the inside of the burner cap 68 by a venturi tube 82 (FIGS. 4 and 8). The lower end of the venturi tube is positioned above the opening 55 in the mounting bracket 35, and the venturi tube extends through an opening in the bottom wall 24 of the grill casing and through an opening 83 (FIG. 10) in the burner pad 59. The gas entrains air as it passes upwardly from the gas jet 42 to the venturi tube 82, and the burner cap forms a mixing chamber for the fuel and air mixture. The fuel and air flows through the burner rings 66 and burns outside of the burner rings.

The three legs 23 support the grill casing above the ground or other supporting surface, and the propane tank 21 is supported directly by the regulator 37. No other supporting structure for the propane tank is required. When the propane tank is empty, it can be replaced simply by unscrewing the outlet bushing 33 from the regulator assembly and replacing the empty tank with a full tank.

While in the foregoing specification a detailed description of a specific embodiment of the invention was set forth for the purpose of illustration, it will be understood that many of the details herein given may be varied considerably by those skilled in the art without departing from the spirit and scope of the invention.

I claim:

1. A gas grill which is adapted to be connected to a propane tank comprising:

(a) a bowl-shaped casing having a bottom wall and an upwardly extending side wall;

(b) a burner bowl supported inside the casing by the bottom wall thereof;

(c) a burner assembly mounted on the burner bowl;

(d) a regulator assembly including a threaded connector adapted to be connected to a propane tank whereby the propane tank is supported solely by the regulator assembly;

(e) a mounting bracket attached to the bottom wall of the casing below the burner bowl, the mounting bracket having a generally flat central portion attached to the regulator assembly and three arms which extend outwardly and upwardly from the central portion and which are attached to the bottom wall of the casing, each of the arms terminating in a generally flat end portion which extends generally parallel to the central portion and which includes a convex embossment which engages the casing in the area of the attachment between the arm and the casing for minimizing heat conduction between the casing and the arm, said arms of the mounting bracket providing the only connection between the regulator assembly and the casing; and (f) a plurality of legs attached to the casing and extending downwardly therefrom for supporting the casing above a support surface so that the propane tank does not contact the support surface.

2. The gas grill of claim 1 in which the regulator assembly includes a control knob and the mounting bracket includes a guard tab which extends outwardly from the central portion of the mounting bracket between the casing and the control knob of the regulator assembly.

3. A gas grill which is adapted to be connected to a propane tank comprising:

(a) a bowl-shaped casing having a bottom wall and an upwardly extending side wall;

(b) a burner bowl supported inside the casing by the bottom wall thereof;

(c) a burner assembly mounted on the burner bowl;

(d) a regulator assembly including a threaded connector adapted to be connected to a propane tank whereby the propane tank is supported solely by the regulator assembly;

(e) a mounting bracket attached to the bottom wall of the casing below the burner bowl, the mounting bracket having a central portion attached to the regulator assembly and a plurality of arms which extend outwardly and upwardly from the central portion and which are attached to the bottom wall of the casing, said arms of the mounting bracket providing the only connection between the regulator assembly and the casing, each of the arms terminating in an end portion which includes a convex embossment which engages the casing in the area of the attachment between the arm and the casing for minimizing heat convection between the casing and the arm;

(f) a plurality of legs attached to the casing and extending downwardly therefrom for supporting the casing above a support surface so that the propane tank does not contact the support surface.

4. In combination, a propane tank and a gas grill, the propane tank being supported solely by the gas grill, the gas grill comprising:

(a) a bowl-shaped casing having a bottom wall and an upwardly extending side wall;

(b) a burner bowl supported inside the casing by the bottom wall thereof;

(c) a burner assembly mounted on the burner bowl;

(d) a regulator assembly including a threaded connector adapted to be connected to the propane tank whereby the propane tank is supported solely by the regulator assembly;

(e) a mounting bracket attached to the bottom wall of the casing below the burner bowl, the mounting bracket having a generally flat central portion attached to the regulator assembly and three arms which extend outwardly and upwardly from the central portion and which are attached to the bottom wall of the casing, each of the arms terminating in a generally flat end portion which extends generally parallel to the central portion and which includes a convex embossment which engages the casing in the area of the attachment between the arm and the casing for minimizing heat conduction between the casing and the arm, said arms of the mounting bracket providing the only connection between the regulator assembly and the casing; and (f) a plurality of legs attached to the casing and extending downwardly therefrom for supporting the casing above a support surface so that the propane tank does not contact the support surface.

5. In combination, a propane tank and a gas grill, the propane tank being supported solely by the gas grill, the gas grill comprising:

(a) a bowl-shaped casing having a bottom wall and an upwardly extending side wall;

(b) a burner bowl supported inside the casing by the bottom wall thereof;

(c) a burner assembly mounted on the burner bowl;

(d) a regulator assembly including a threaded connector adapted to be connected to the propane tank whereby the propane tank is supported solely by the regulator assembly;

(e) a mounting bracket attached to the bottom wall of the casing below the burner bowl, the mounting bracket having a central portion attached to the regulator assembly and a plurality of arms which extend outwardly and upwardly from the central portion and which are attached to the bottom wall of the casing, said arms of the mounting bracket providing the only connection between the regulator assembly and the casing, each of the arms terminating in an end portion which includes a convex embossment which engages the casing in the area of the attachment between the arm and the casing for minimizing heat convection between the casing and the arm;

(f) a plurality of legs attached to the casing and extending downwardly therefrom for supporting the casing above a support surface so that the propane tank does not contact the support surface.

* * * * *